US011781753B2

(12) United States Patent
Ganiger et al.

(10) Patent No.: US 11,781,753 B2
(45) Date of Patent: Oct. 10, 2023

(54) COMBUSTOR DOME-DEFLECTOR AND LINER HAVING FLEXIBLE CONNECTIONS

(71) Applicant: General Electric Company, Schenectady, NY (US)

(72) Inventors: Ravindra Shankar Ganiger, Bengaluru (IN); Hiranya Nath, Bengaluru (IN); Sripathi Mohan, Bengaluru (IN); Girish Kamath Cannanore, Bengaluru (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/809,629

(22) Filed: Jun. 29, 2022

(65) Prior Publication Data

US 2023/0272912 A1 Aug. 31, 2023

(30) Foreign Application Priority Data

Feb. 28, 2022 (IN) ..... 202211010656

(51) Int. Cl.

| | |
|---|---|
| ***F23R 3/00*** | (2006.01) |
| ***F23R 3/60*** | (2006.01) |
| ***F23R 3/50*** | (2006.01) |
| ***F23M 5/04*** | (2006.01) |

(52) U.S. Cl.

CPC ..... *F23R 3/60* (2013.01); *F23M 5/04* (2013.01); *F23R 3/002* (2013.01); *F23R 3/50* (2013.01); *F23R 2900/00014* (2013.01); *F23R 2900/00017* (2013.01); *F23R 2900/03044* (2013.01)

(58) Field of Classification Search

CPC ... F05D 2260/31; F05D 2260/38; F23M 5/04; F23R 3/002; F23R 3/50; F23R 3/60; F23R 2900/00017; F23R 2900/03044

See application file for complete search history.

(56) References Cited

U.S. PATENT DOCUMENTS

| | | | |
|---|---|---|---|
| 4,437,286 | A | 3/1984 | Maguire |
| 4,917,554 | A | 4/1990 | Bronn |
| 6,908,275 | B2 | 6/2005 | Nelson et al. |
| 7,249,923 | B2 | 7/2007 | Niku |
| 8,191,224 | B2 | 6/2012 | Richards |
| 9,145,908 | B2 | 9/2015 | Gill et al. |
| 10,422,532 | B2 | 9/2019 | Sadil et al. |
| 10,605,290 | B1 | 3/2020 | Roskwitalski |
| 10,969,103 | B2 | 4/2021 | Chang et al. |

(Continued)

FOREIGN PATENT DOCUMENTS

| | | | |
|---|---|---|---|
| CN | 106122221 | A | 11/2016 |
| CN | 108980179 | B | 9/2020 |

(Continued)

*Primary Examiner* — Scott J Walthour

(74) *Attorney, Agent, or Firm* — Venable LLP; Edward A. Kmett; Michele V. Frank

(57) ABSTRACT

A combustor for a gas turbine includes a dome, and a deflector connected to the dome to define a baffle cavity therebetween, the deflector having a deflector cold side adjacent to the baffle cavity and a deflector hot side adjacent to a combustion chamber. At least one dome-deflector connecting member connects the dome and the deflector to each other. The dome-deflector connecting member forms a flexible joint between the dome and the deflector.

13 Claims, 10 Drawing Sheets

(56) References Cited

U.S. PATENT DOCUMENTS

| | | | | |
|---|---|---|---|---|
| 2007/0107710 | A1* | 5/2007 | De Sousa | F23R 3/007 123/657 |
| 2010/0143069 | A1 | 6/2010 | Moore | |
| 2014/0109594 | A1* | 4/2014 | Casavant | F01D 9/023 60/796 |
| 2016/0186997 | A1* | 6/2016 | Sadil | F02C 7/16 411/347 |
| 2018/0073736 | A1* | 3/2018 | Papple | F23R 3/10 |
| 2018/0283691 | A1* | 10/2018 | Corsmeier | F16B 39/06 |

FOREIGN PATENT DOCUMENTS

| | | | |
|---|---|---|---|
| CN | 110259803 | B | 6/2021 |
| JP | 2014-514018 | A | 6/2014 |

* cited by examiner

COMBUSTOR DOME-DEFLECTOR AND LINER HAVING FLEXIBLE CONNECTIONS

CROSS REFERENCE TO RELATED APPLICATIONS

The present application claims the benefit of Indian Patent Application No. 202211010656, filed on Feb. 28, 2022, which is hereby incorporated by reference herein in its entirety.

TECHNICAL FIELD

The present disclosure relates to joints between a dome and a deflector or a multi-layer liner in a combustor of a gas turbine.

BACKGROUND

Some gas turbine engines include a combustor that has a dome structure with a deflector connected to the dome structure by being bolted to the dome structure. Additionally, such a combustor may also include a multi-layer combustor liner that includes an outer liner shell and panels connected thereto via a bolted joint, with a cooling airflow space between the outer liner shell and the panels. The bolted joints of the dome-deflector connection, and the bolted joints of the outer liner shell-to-panel connection are subjected to intense heat from combustion within the combustor. The bolted joints are, therefore, subject to thermal expansion. The bolted joints are also subject to vibrations, including vibrations caused by combustion dynamics of the combustion process within the combustor.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first" or "second" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Some gas turbine engines include a combustor that has a dome structure with a deflector connected to the dome structure by being bolted to the dome structure. Additionally, such a combustor may also include a multi-layer combustor liner that includes an outer liner shell and panels connected thereto via a bolted joint, with a cooling airflow space between the outer liner shell and the panels. The bolted joints of the dome-deflector connection, and the bolted joints of the outer liner shell-to-panel connection are subjected to intense heat from combustion within the combustor. The bolted joints are, therefore, subject to thermal expansion. The bolted joints are also subject to vibrations, including vibrations caused by combustion dynamics of the combustion process within the combustor.

The present disclosure provides a technique for connecting the dome and deflector so as to accommodate the thermal expansion of the joints, and to accommodate the vibrations at the joint. More particularly, in the present disclosure, flexible compliant joints are provided between the dome and the deflector or between the outer liner shell and the combustor panels. The flexible compliant joints may, for example, include a flexible bolt or a flexible coupler that are both flexible in their structure, but that also provide cooling to the joint. Alternatively, various other joints that provide for flexure of the joint and cooling of the joint may also be included. Thus, the various joint arrangements can accommodate thermal loads on the joints and can also accommodate vibrations incurred during the combustion process.

Figure 1:
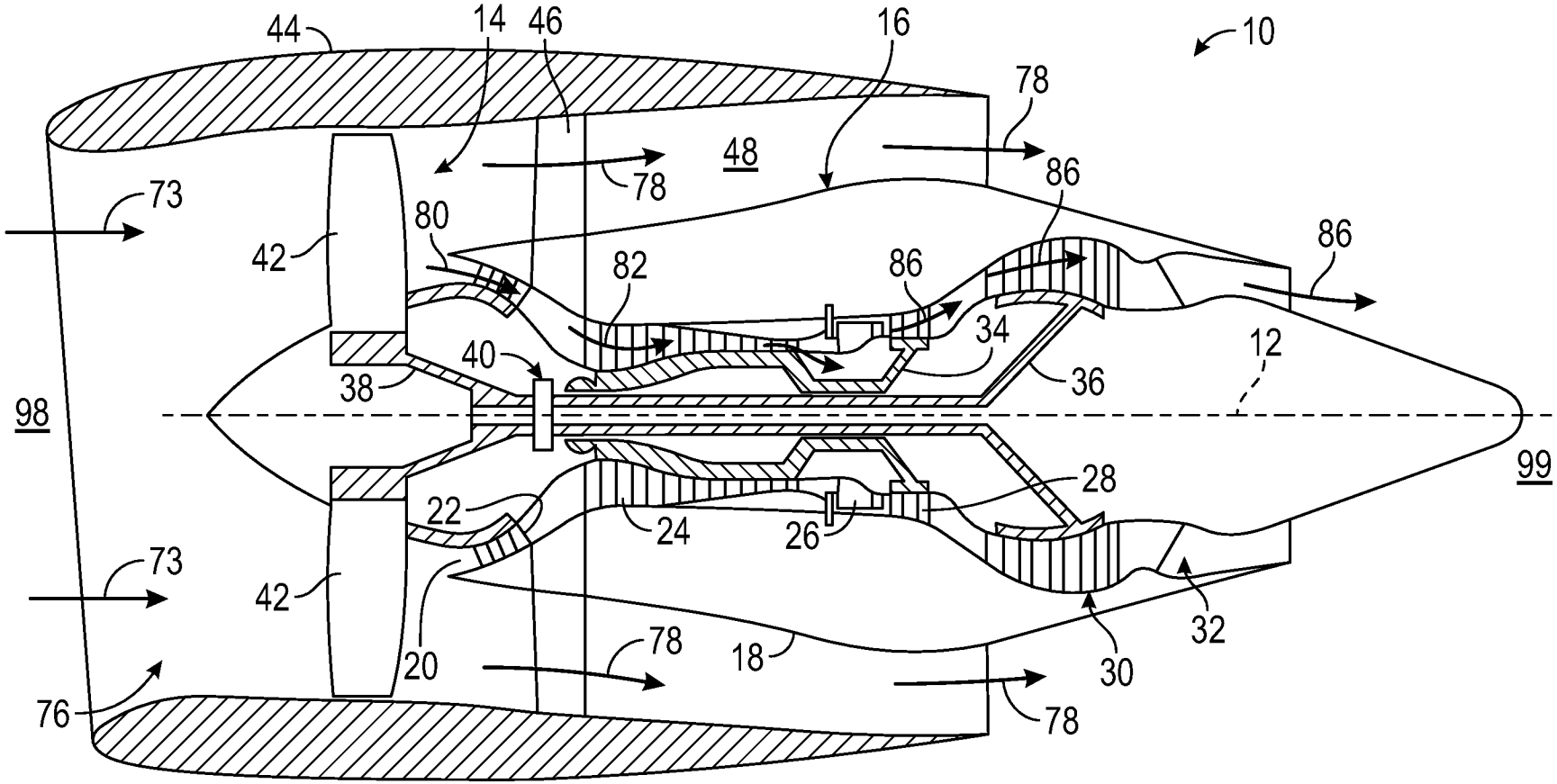
FIG. 1 is a schematic partial cross-sectional side view of an exemplary high by-pass turbofan jet engine, according to an aspect of the present disclosure.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine-based turbine engines, industrial turbine engines, and auxiliary power units. As shown in FIG. 1, the engine 10 has an axial centerline axis 12 that extends therethrough from an upstream end 98 to a downstream end 99 for reference purposes. In general, the engine 10 may include a fan assembly 14 and a core engine 16 disposed downstream from the fan assembly 14.

The core engine 16 may generally include an outer casing 18 that defines an annular inlet 20. The outer casing 18 encases, or at least partially forms, in serial flow relationship, a compressor section (22/24) having a low pressure (LP) compressor 22 and a high pressure (HP) compressor 24, a combustor 26, a turbine section (28/30) including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration.

As shown in FIG. 1, the fan assembly 14 includes a plurality of fan blades 42 that are coupled to, and that extend radially outwardly from, the fan shaft 38. An annular fan casing or a nacelle 44 circumferentially surrounds the fan assembly 14 and/or at least a portion of the core engine 16. The nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
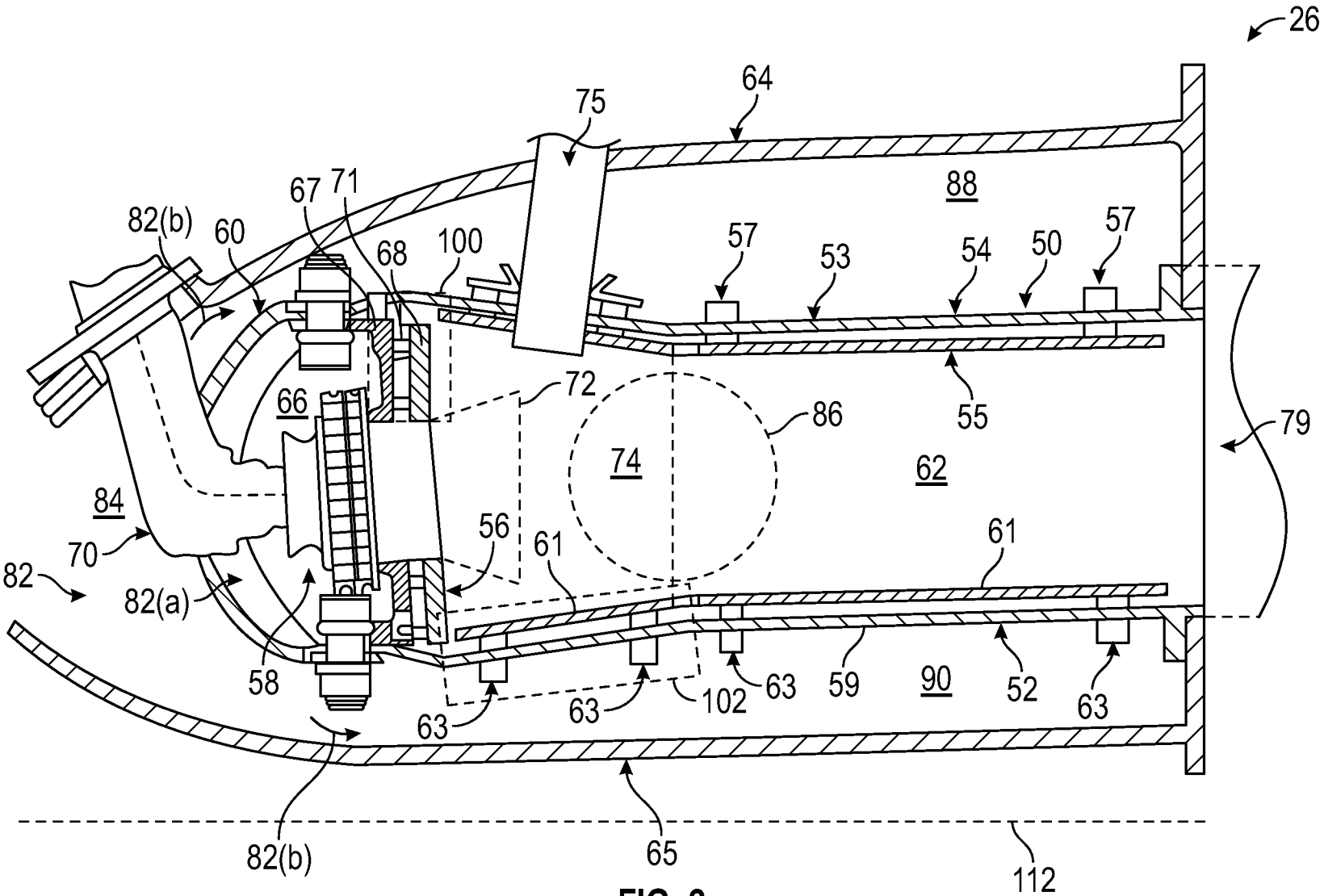
FIG. 2 is a partial cross-sectional side view of an exemplary combustor, according to an aspect of the present disclosure.

FIG. 2 is a cross-sectional side view of an exemplary combustor 26 of the core engine 16 as shown in FIG. 1. As shown in FIG. 2, the combustor 26 may generally include a combustor liner 50 having an inner liner 52 and an outer liner 54, and a dome assembly 56, together defining a combustion chamber 62. Both the inner liner 52 and the outer liner 54 may extend circumferentially about a combustor centerline axis 112, which may correspond to the engine axial centerline axis 12 (FIG. 1). The inner liner 52 and the outer liner 54 are connected to a cowl 60, and a pressure plenum 66 is defined between the cowl 60, the inner liner 52, the outer liner 54, and the dome assembly 56. The combustor 26 also includes a mixer assembly 58 that is connected to a fuel nozzle assembly 70. While FIG. 2 depicts a single mixer assembly 58 and a single fuel nozzle assembly 70, a plurality of mixer assemblies 58 and respective fuel nozzle assemblies 70 may be included in the combustor 26, where each respective mixer assembly 58 and fuel nozzle assembly 70 are circumferentially spaced about the combustor centerline axis 112.

As shown in FIG. 2, the inner liner 52 is encased within an inner casing 65 and the outer liner 54 is encased within an outer casing 64. An outer flow passage 88 is defined between the outer liner 54 and the outer casing 64, and an inner flow passage 90 is defined between inner liner 52 and the inner casing 65. Both the outer casing 64 and the inner casing 65 may extend circumferentially about the combustor centerline axis 112. The inner liner 52 and the outer liner 54 may extend from the dome assembly 56 to a turbine nozzle 79 at an entry to the HP turbine 28 (FIG. 1), thus at least partially defining a hot gas path between the combustor liner 50 and the HP turbine 28. The combustion chamber 62 may more specifically define a primary combustion zone 74 at which an initial chemical reaction of a fuel-oxidizer mixture 72 occurs to generate combustion gases 86, and/or where recirculation of the combustion gases 86 may occur before the combustion gases 86 flow further downstream within the combustion chamber 62 and into the turbine nozzle 79 at the entry to the HP turbine 28 and the LP turbine 30 (FIG. 1). As will be described in more detail below, the outer liner 54 may be a multi-layer liner that includes an outer liner shell 53 and outer liner panels 55 that are connected to the outer liner shell 53 via a plurality of outer liner shell-to-panel connecting members 57. Similarly, the inner liner 52 may be a multi-layer liner that includes an inner liner shell 59 and inner liner panels 61 that are connected to the inner liner shell 59 via a plurality of inner liner shell-to-panel connecting members 63. In addition, as will be described in more detail below, the dome assembly 56 may include a dome 67 and a deflector 68 connected to the dome 67 via at least one dome-deflector connecting member 71.

During operation of the engine 10, as shown in FIGS. 1 and 2 collectively, a volume of air, as indicated schematically by arrows 73, enters the engine 10 from the upstream end 98 through an associated nacelle inlet 76 of the nacelle 44 and/or the fan assembly 14. As the air 73 passes across the fan blades 42, a portion of the air 73 is directed or routed into the bypass airflow passage 48 as a bypass airflow 78, while another portion of the air 73 is directed or routed into the LP compressor 22 as a compressor inlet air 80. The compressor inlet air 80 is progressively compressed as it flows through the LP compressor 22 and the HP compressor 24 towards the combustor 26. As shown in FIG. 2, compressed air 82 flows into and pressurizes a diffuser cavity 84. A first portion of the compressed air 82, as indicated schematically by arrows 82(*a*), flows from the diffuser cavity 84 into the pressure plenum 66, where it is mixed by mixer assembly 58 with fuel provided by the fuel nozzle assembly 70. The fuel-oxidizer mixture 72 is then ejected into the combustion chamber 62 by the mixer assembly 58. The fuel-oxidizer mixture 72 is ignited by an ignitor 75 and burned to generate the combustion gases 86 within the primary combustion zone 74 of the combustion chamber 62. Typically, the LP compressor 22 and the HP compressor 24 provide more compressed air 82 to the diffuser cavity 84 than is needed for combustion. Therefore, a second portion of the compressed air 82, as indicated schematically by arrows 82(*b*), may be used for various purposes other than combustion. For example, as shown in FIG. 2, compressed air 82(*b*) may be routed into the outer flow passage 88, and another portion of the compressed air 82(*b*) may be routed into the inner flow passage 90. In addition, or in the alternative, at least a portion of the compressed air 82(*b*) may be routed out of the diffuser cavity 84 for other purposes, such as to provide cooling air to at least one of the HP turbine 28 or the LP turbine 30.

Referring back to FIGS. 1 and 2 collectively, the combustion gases 86 generated in the combustion chamber 62 flow through the turbine nozzle 79 and into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsion at the downstream end 99.

Figure 3:
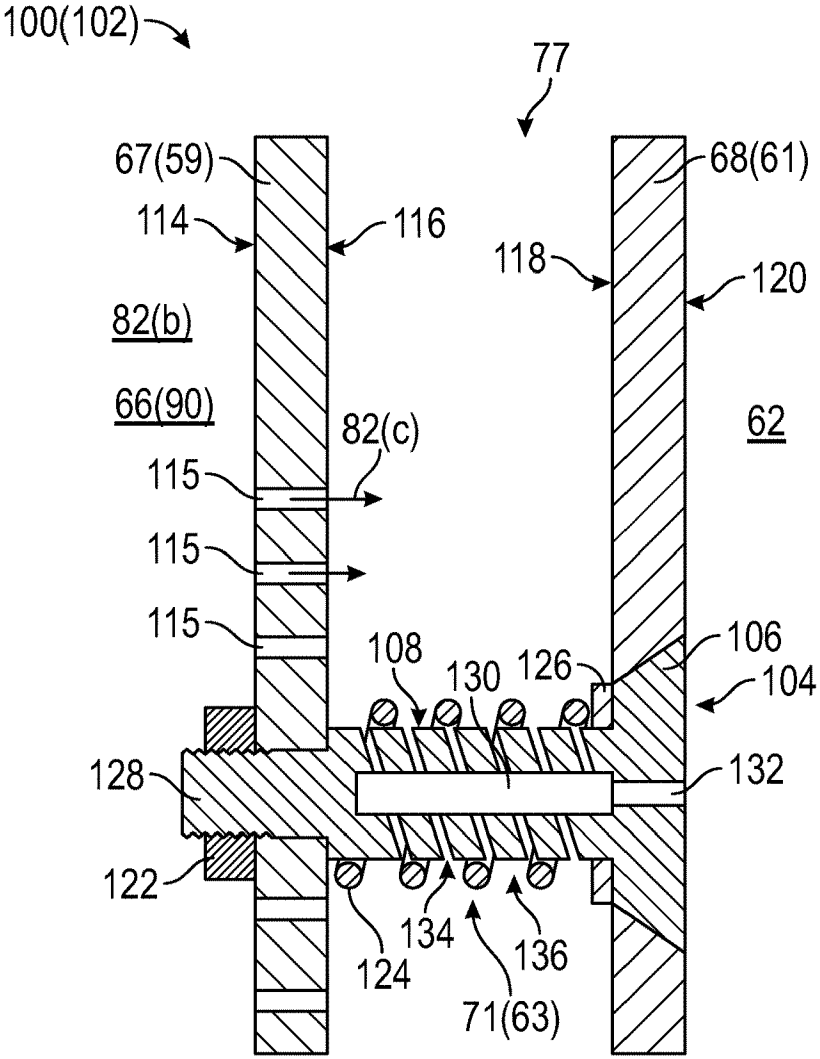
FIG. 3 is a schematic partial cross-sectional view of an alternate aspect of a dome-deflector connection, according to an aspect of the present disclosure.

FIG. 3 is a schematic partial cross-sectional view of an alternate aspect of a dome-deflector connection, according to an aspect of the present disclosure. FIG. 3 depicts one example of a dome-deflector connecting member 71 for implementing the flexible connection between the dome 67 and the deflector 68. The dome-deflector connecting member 71 can also be implemented as the outer liner shell-to-panel connecting member 57 and as the inner liner shell-to-panel connecting member 63. As such, while the detail view 100 for the dome-deflector connecting member 71 will be described hereafter for each type of connecting member, the figures also depict, when applicable, elements for a detail view 102 of the inner liner shell-to-panel connecting member 63. Therefore, reference numerals applicable to the inner liner shell-to-panel connecting member 63 will be included in the following figures in parentheses.

In the FIG. 3 aspect, the dome 67 is connected to the deflector 68 via the dome-deflector connecting member 71 to define a baffle cavity 77 between the dome 67 and the deflector 68. The dome 67 includes a cold side 114 of the dome 67 adjacent to the pressure plenum 66, and a hot side 116 of the dome 67 adjacent to the baffle cavity 77. The dome 67 includes a plurality of dome airflow cooling passages 115 that allow a portion of the compressed air 82(*b*) from the pressure plenum 66 to flow through the dome airflow cooling passages 115 into the baffle cavity 77 as a cooling airflow 82(*c*) to impinge upon a cold side 118 of the deflector 68. The deflector 68 includes the cold side 118 of the deflector 68 adjacent to the baffle cavity 77 and a deflector hot side 120 adjacent to the combustion chamber 62. The dome-deflector connecting member 71 is implemented as a bolted joint 103 in FIG. 3, including a flexible bolt 104, a nut 122, a spring 124, and a washer 126. The nut 122 engages with a threaded portion 128 of the flexible bolt 104 to connect the flexible bolt 104 to the dome 67. The flexible bolt 104 includes a bolt head 106 that engages with the hot side 120 of the deflector 68. The spring 124 provides a force between the dome 67 and the deflector 68 to retain engagement of the bolt head 106 with the deflector 68. As an alternative to the spring 124 and the washer 126, the bolt head 106 may be joined to the deflector 68, such as by being brazed to the deflector 68.

The flexible bolt 104 also includes a flexible shank portion 108. The flexible shank portion 108 may be formed from a hollow cylindrical shank in which a helical serration 134 is cut through the shank along a length of the shank, thereby forming a heli-coil-type shank 136 that defines a hollow cavity 130 therewithin. The bolt head 106 includes a cooling passage 132 extending therethrough that is in fluid communication with the hollow cavity 130. Thus, the cooling airflow 82(*c*) entering the baffle cavity 77 via the dome airflow cooling passages 115 can flow through the heli-coil-type shank 136 into the hollow cavity 130 and through the cooling passage 132 of the bolt head 106 to provide cooling to the bolt head 106 at the hot side 120 of the deflector 68.

Figure 4:
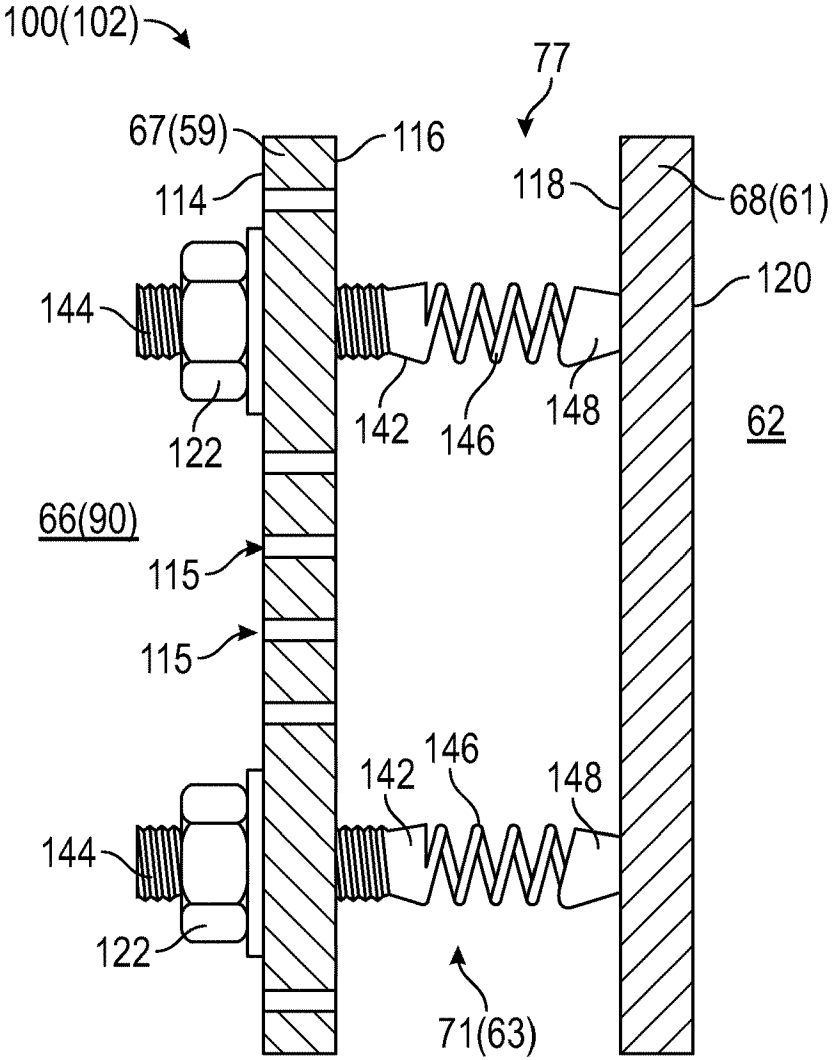
FIG. 4 is a schematic partial cross-sectional view of an alternate aspect of a dome-deflector connection, according to another aspect of the present disclosure.

FIG. 4 is a schematic partial cross-sectional view of an alternate aspect of a dome-deflector connection, according to another aspect of the present disclosure. The FIG. 4 aspect is similar to the FIG. 3 aspect in that it includes a bolted joint having a flexible bolt 142. The flexible bolt 142 includes a threaded shank portion 144 that engages with the nut 122 to connect the flexible bolt 142 to the dome 67. The flexible bolt 142 of the FIG. 4 aspect includes a heli-coil shank portion 146 that connects the threaded shank portion 144 to a head 148. The head 148 may be joined to the deflector 68 via, for example, being brazed to the deflector 68. Alternatively, when the deflector 68 may be made of a ceramic matrix composite (CMC) material, the deflector 68 may include an insert (not shown) that may be threadedly engaged with the head 148.

Figure 5:
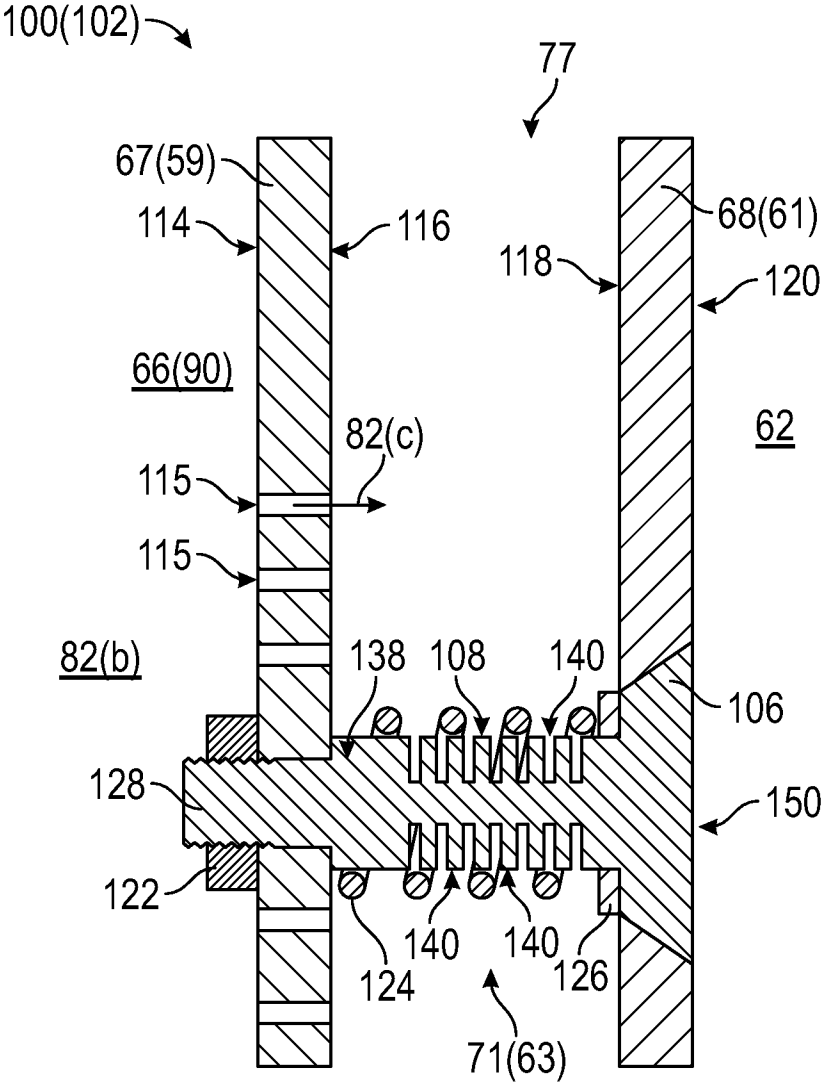
FIG. 5 is a schematic partial cross-sectional view of an alternate aspect of a dome-deflector connection, according to still another aspect of the present disclosure.

FIG. 5 is a schematic partial cross-sectional view of an alternate aspect of a dome-deflector connection, according to still another aspect of the present disclosure. The FIG. 5 aspect is similar to the FIG. 3 aspect in that it includes a bolted joint having a flexible bolt 150. The flexible bolt 150 of the FIG. 5 aspect includes the threaded portion 128 that engages with the nut 122 to connect the flexible bolt 150 to the dome 67. The flexible bolt 150, however, rather than including a heli-coil shank portion or a heli-coil type shank portion, includes a solid shank core portion 138 that has a plurality of circumferential serrations 140. The circumferential serrations 140 allow for more flexibility of the flexible bolt 150, and also function as cooling fins to provide cooling to the flexible bolt 150.

Figure 6:
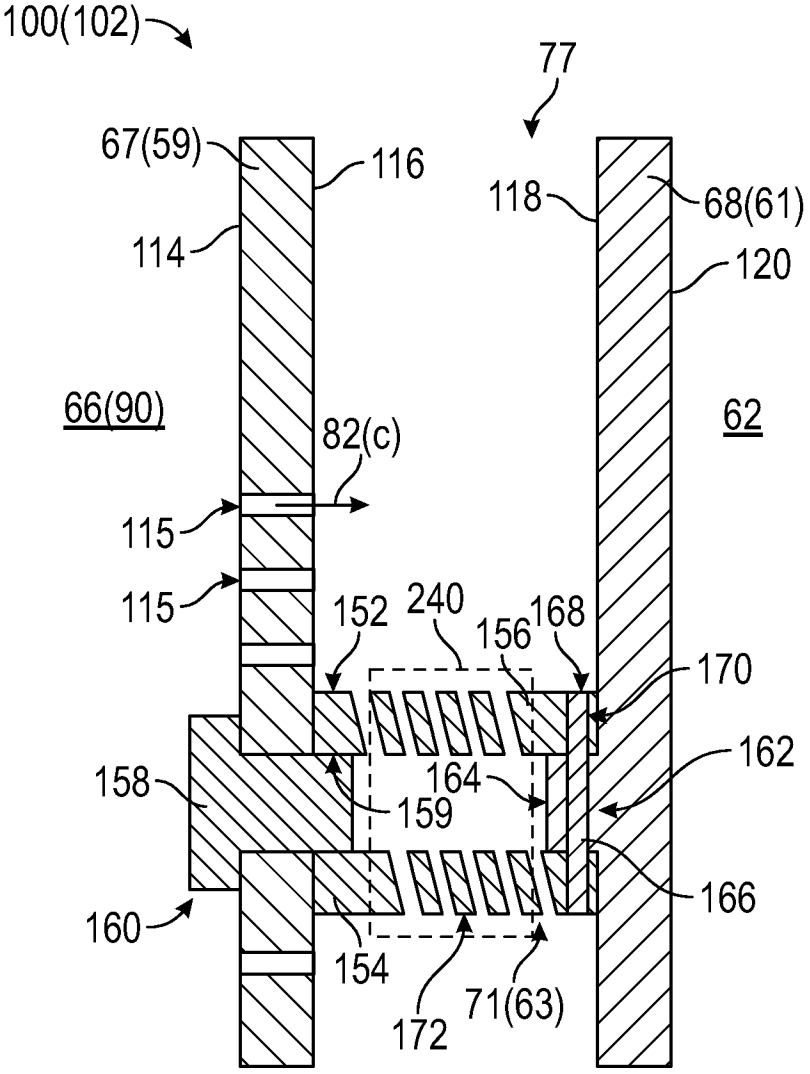
FIG. 6 is a schematic partial cross-sectional view of an alternate aspect of a dome-deflector connection, according to yet another aspect of the present disclosure.

FIG. 6 is a schematic partial cross-sectional view of an alternate aspect of a dome-deflector connection, according to yet another aspect of the present disclosure. In the FIG. 6 aspect, the dome-deflector connecting member 71 is a flexible coupler 152 connected to the dome 67 at a first end 154 of the flexible coupler 152, and connected to the deflector 68 at a second end 156 of the flexible coupler 152. In FIG. 6, the flexible coupler 152 is shown as being connected to the dome 67 at the first end 154, with the first end 154 engaging against the hot side 116 of the dome 67 and being connected to the dome 67 via a bolted joint 160. The bolted joint 160 includes a bolt 158 that engages with an internally threaded surface 159 of the first end 154 of the flexible coupler 152. The flexible coupler 152 is also shown as being connected to the deflector 68 at the second end 156, with the second end 156 engaging against the cold side 118 of the deflector 68 and being connected via a pinned joint 162. The pinned joint 162 may include a deflector connecting projection 164 extending from the cold side 118 of the deflector 68 into the baffle cavity 77, where the deflector connecting projection 164 includes a pin hole 168 therethrough. The deflector connecting projection 164 is arranged to fit within the second end 156 of the flexible coupler 152. The second end 156 of the flexible coupler 152 includes a pin hole 170 therethrough, and is arranged so that a pin 166 can be inserted through the pin hole 170 and the pin hole 168 to connect the flexible coupler 152 to the deflector 68. Of course, other techniques can be used for connecting the flexible coupler 152 to the dome 67 and to the deflector 68, and some other techniques will be described below.

Figure 13A:
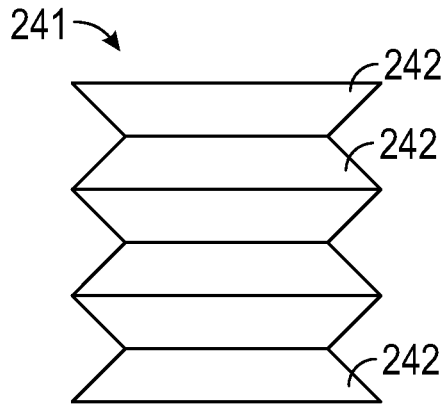
FIGS. 13A and 13B depict alternate arrangements of a flexible middle portion of a flexible coupler, according to the present disclosure.
Figure 13B:
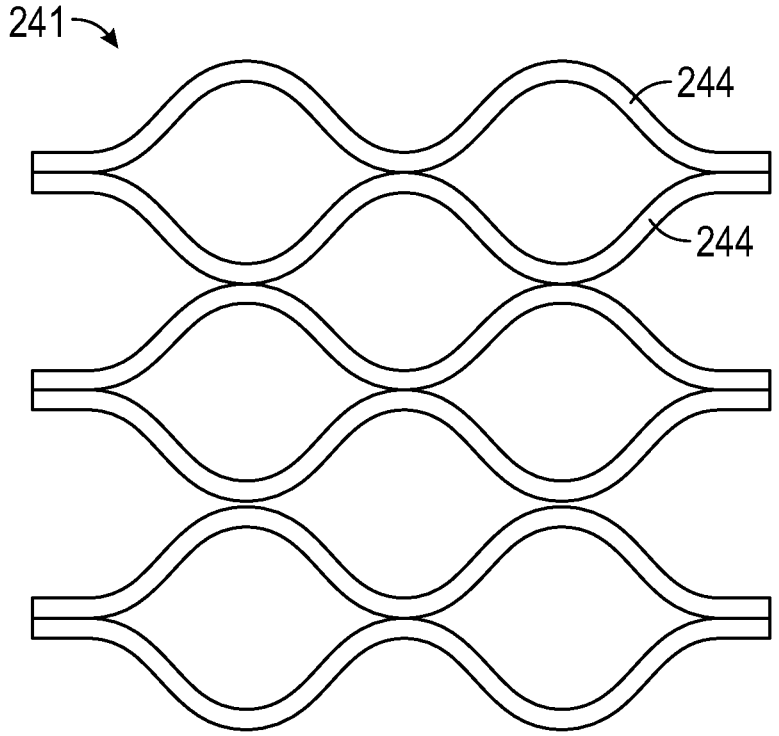

The flexible coupler 152 includes a flexible middle section 172 between the first end 154 of the flexible coupler 152 and the second end 156 of the flexible coupler 152. The flexible middle section 172 may include a heli-coil-type structure similar to the heli-coil-type shank 136 of the flexible bolt 104 (FIG. 3). Alternatively, as shown in FIG. 13A, which is an alternate arrangement at detail view 240 of FIG. 6, the flexible middle section 172 may comprise a spring-like structure 241 that is formed from a plurality of belleville-type washers 242 being joined together to form the spring-like structure 241. In another alternative arrangement of FIG. 13B, the flexible middle section 172 may form a spring-like structure 241 that is formed of a plurality of stacked waveform elements 244, such as a waveform washer, that are joined to one another. Thus, the flexible coupler 152 provides for a flexible connection between the dome 67 and the deflector 68.

Figure 7:
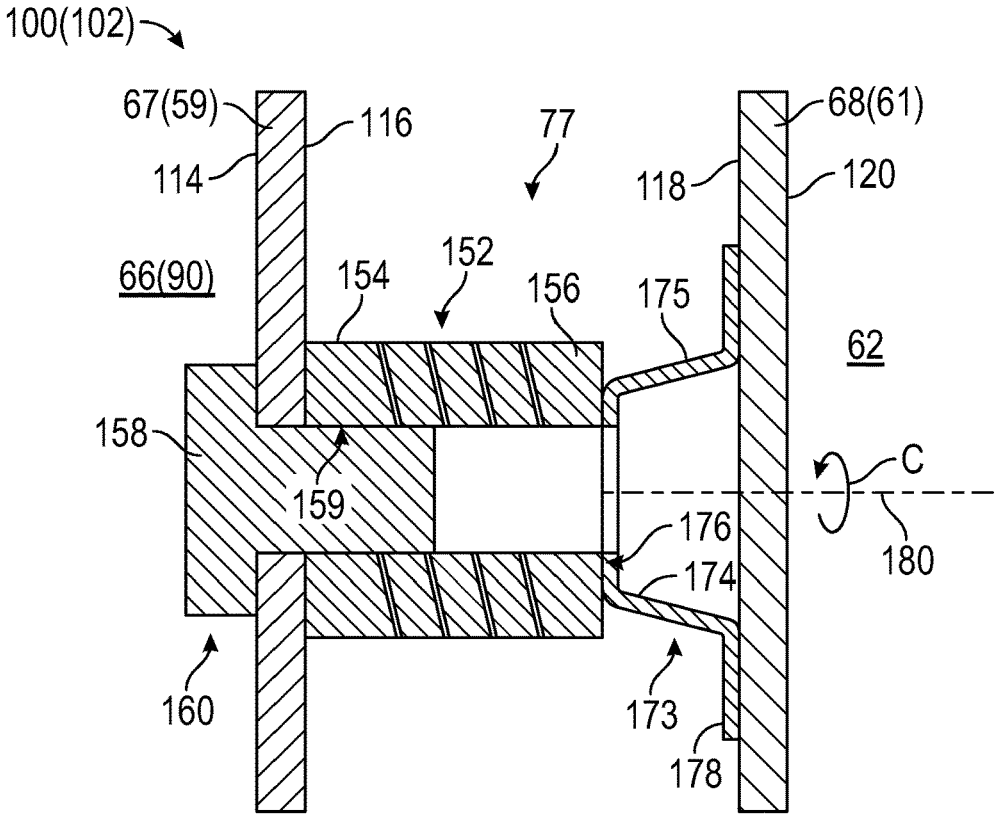
FIG. 7 is a schematic partial cross-sectional view of an alternate aspect of a dome-deflector connection, according to still yet another aspect of the present disclosure.

FIG. 7 is a schematic partial cross-sectional view of an alternate aspect of a dome-deflector connection, according to still yet another aspect of the present disclosure. The FIG. 7 aspect includes the flexible coupler 152 of FIG. 6, but includes a different connection type for connecting the flexible coupler 152 to the deflector 68. In FIG. 7, the first end 154 of the flexible coupler 152 is shown as being connected to the dome 67 with the bolted joint 160 in the same manner as shown in FIG. 6. However, the second end 156 of the flexible coupler 152 is shown as being connected to the deflector 68 via a mounting bracket joint 173. The mounting bracket joint 173 may include a mounting bracket 174 that is generally circular in shape and includes a conical wall 175 that extends circumferentially about a centerline 180 of the mounting bracket 174, a flange 176 that extends radially inward toward the centerline 180, and a flange 178 that extends radially outward with respect to the centerline 180. The flange 176 may be joined to the second end 156 of the flexible coupler 152 via, for example, being brazed, and the flange 178 may be joined to the cold side 118 of the deflector 68 by, for example, being brazed.

Figure 8:
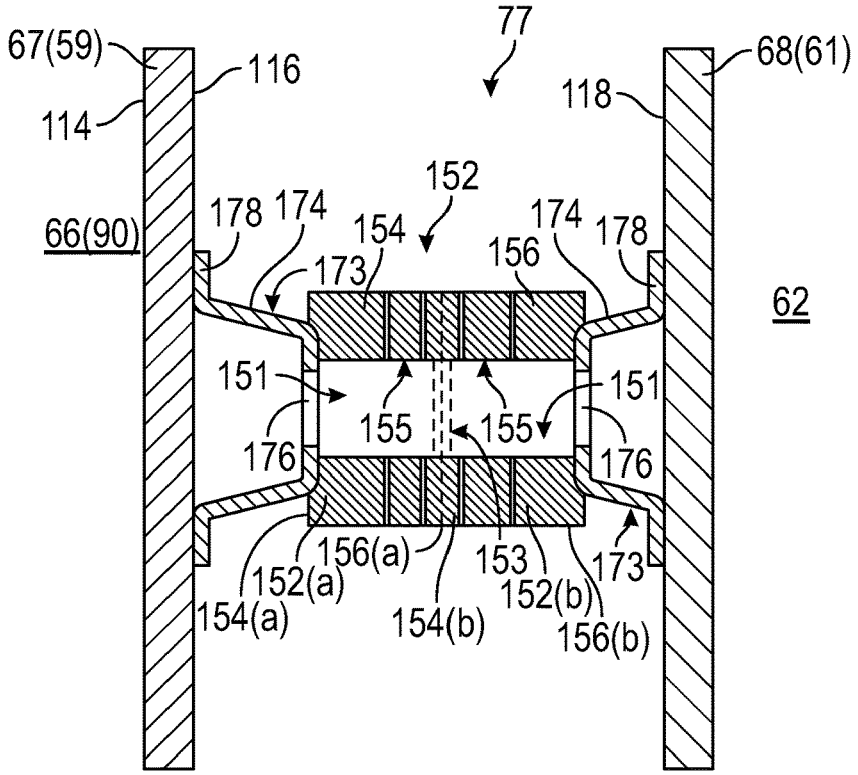
FIG. 8 is a schematic partial cross-sectional view of an alternate aspect of a dome-deflector connection, according to still another aspect of the present disclosure.

FIG. 8 is a schematic partial cross-sectional view of an alternate aspect of a dome-deflector connection, according to still yet another aspect of the present disclosure. The FIG. 8 aspect includes the flexible coupler 152 of FIG. 7, and also includes the mounting bracket joint 173 for connecting the second end 156 of the flexible coupler 152 to the deflector 68. However, in FIG. 8, the first end 154 is shown to be connected to the dome 67 via a second mounting bracket joint 173 rather than via the bolted joint 160. Thus, the flange 176 of the mounting bracket 174 is joined to the first end 154 of the flexible coupler 152 via, for example, being brazed, and the flange 178 is joined to the hot side 116 of the dome 67 via, for example, being brazed.

While FIG. 8 generally depicts, in one aspect, a single flexible coupler 152 implementing the dome-deflector connecting member 71, the dome-deflector connecting member 71 may instead include multiple flexible couplers 152(*a*) and 152(*b*) stacked together. For example, the dome-deflector connecting member 71 may include a first flexible coupler 152(*a*) and a second flexible coupler 152(*b*) that are connected to each other by, for example, the second end 156(*a*) of the first flexible coupler 152(*a*) being connected to the first end 154(*b*) of the second flexible coupler 152(*b*) via a connecting member 153. Each of the first flexible coupler 152(*a*) and the second flexible coupler 152(*b*) may include a cavity 151 therethrough having a threaded inner surface 155. The connecting member 153 may also have threads that threadedly engage with the threaded inner surface 155 to connect the first flexible coupler 152(*a*) and the second flexible coupler 152(*b*). The first end 154(*a*) of the first flexible coupler 152(*a*) may be connected to the dome 67 via the mounting bracket 174 or in any manner shown in FIGS. 6 and 7, and the second flexible coupler 152(*b*) may be connected to the deflector 68 at a second end 156(*b*) of the second flexible coupler 152(*b*) via the mounting bracket 174 or via any manner shown in FIGS. 6 and 7. Thus, additional flexibility can be achieved by implementing multiple flexible couplers 152(*a*) and 152(*b*) within a single dome-deflector connecting member 71.

Figure 9:
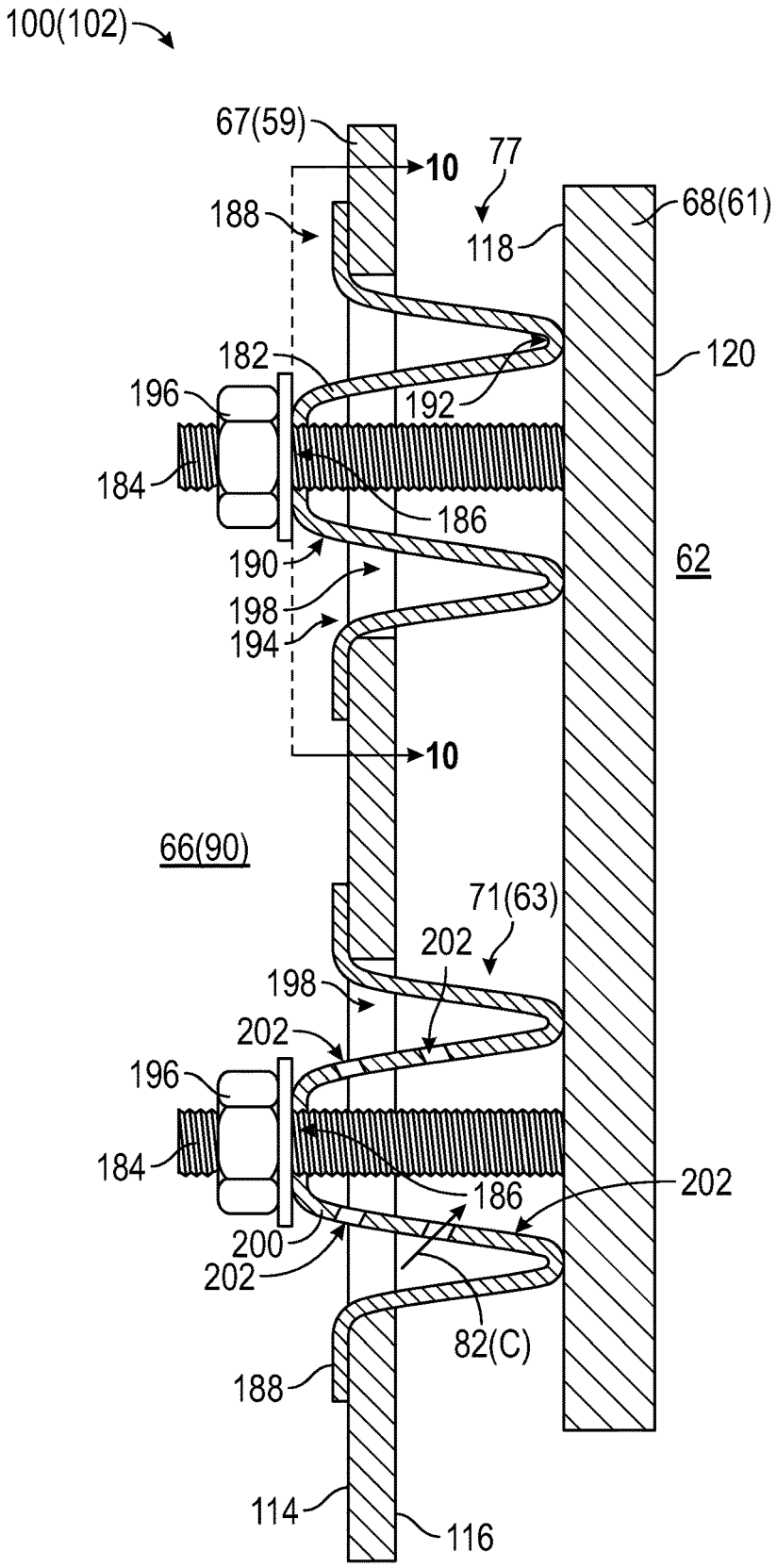
FIG. 9 is a schematic partial cross-sectional view of an alternate aspect of a dome-deflector connection, according to yet another aspect of the present disclosure.
Figure 10:
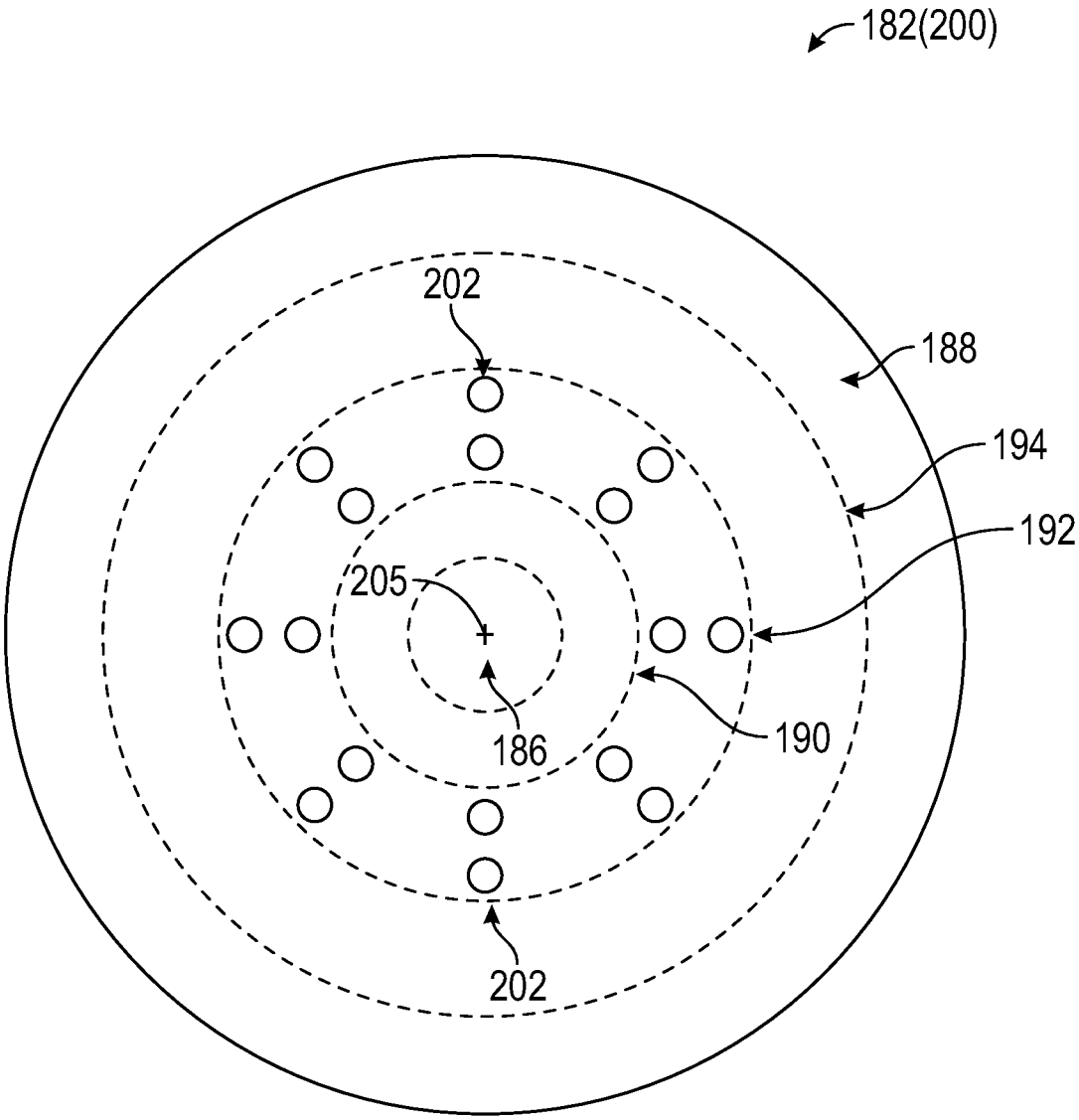
FIG. 10 is a plan view from a cold side of a dome of a ripple-shaped flexible washer, according to an aspect of the present disclosure.

FIG. 9 is a schematic partial cross-sectional view of an alternate aspect of a dome-deflector connection, according to still another aspect of the present disclosure. In the FIG. 9 aspect, the dome-deflector connecting member 71 includes a ripple-shaped flexible washer 182 that extends through a dome opening 198 in the dome 67 and is connected to a stud 184 that extends from the cold side 118 of the deflector 68. The stud 184 may either be joined to the deflector 68 by, for example, being brazed, or may be threadedly engaged with an insert (not shown) in the deflector 68. The ripple-shaped flexible washer 182 includes a center opening 186 therethrough, and the stud 184 extends through the center opening 186. The ripple-shaped flexible washer 182 has a radially outer flange 188 that engages with the cold side 114 of the dome 67. In the cross-sectional view of FIG. 9, the ripple-shaped flexible washer 182 is seen to have a generally sine wave shape, but, in the plan view of FIG. 10, taken from the cold side 114 of the dome 67, the ripple-shaped flexible washer 182 may be seen to have a generally circular shape. In FIG. 10, a bend 190 in the ripple-shaped flexible washer 182, a bend 192 in the ripple-shaped flexible washer 182, and a bend 194 in the ripple-shaped flexible washer 182 are represented with dashed lines. As shown in FIG. 9, the bend 192 of the ripple-shaped flexible washer 182 engages against the cold side 118 of the deflector 68. To complete the flexible connection of the dome 67 to the deflector 68, a nut 196 is threadedly engaged to the stud 184 so as to provide a predetermined amount of pressure between the radially outer flange 188 of the ripple-shaped flexible washer 182 and the cold side 114 of the dome 67, and between the bend 192 of the ripple-shaped flexible washer 182 and the cold side 118 of the deflector 68.

In FIG. 9, as an alternative arrangement, a ripple-shaped flexible washer 200 may be provided, where the ripple-shaped flexible washer 200 is the same as the ripple-shaped flexible washer 182, except that the ripple-shaped flexible washer 200 may include a plurality of cooling openings 202 therethrough. FIG. 10 depicts the cooling openings 202 circumferentially spaced about a center 205 of the ripple-shaped flexible washer 200. The cooling openings 202 may provide for the cooling airflow 82(*c*) to flow from the pressure plenum 66 through the cooling openings 202 so as to provide impingement cooling against the cold side 118 of the deflector 68.

Figure 11:
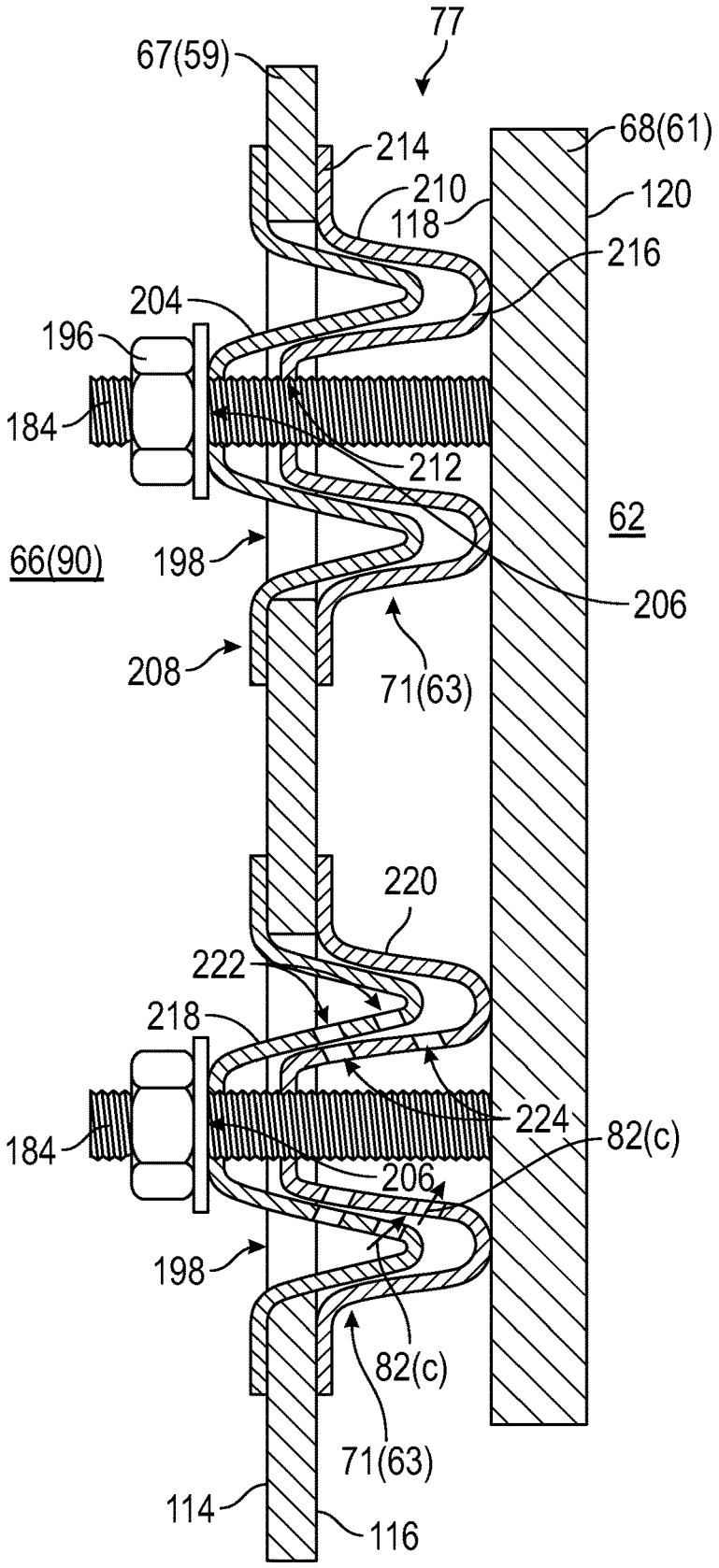
FIG. 11 is a schematic partial cross-sectional view of an alternate aspect of a dome-deflector connection, according to yet another aspect of the present disclosure.

FIG. 11 is a schematic partial cross-sectional view of an alternate aspect of a dome-deflector connection, according to another aspect of the present disclosure. The FIG. 11 aspect is somewhat similar to the FIG. 9 aspect in that ripple-shaped flexible washers are implemented within the dome-deflector connecting member 71. Similar to the FIG. 9 aspect, studs 184 extend from the cold side 118 of the deflector 68. A first ripple-shaped flexible washer 204 has a first washer center opening 206 therethrough, and the stud 184 extends through the first washer center opening 206. Similar to the ripple-shaped flexible washer 182, the first ripple-shaped flexible washer 204 has a first washer radially outer flange 208 that engages with the cold side 114 of the dome 67. The first ripple-shaped flexible washer 204 extends through the dome opening 198 into the baffle cavity 77. However, unlike the FIG. 9 aspect, the first ripple-shaped flexible washer 204 does not engage with the cold side 118 of the deflector 68. Rather, in the FIG. 11 aspect, a second ripple-shaped flexible washer 210 having a second washer center opening 212 therethrough engages with the stud 184. The second ripple-shaped flexible washer 210 includes a second washer radially outer flange 214 that engages with the hot side 116 of the dome 67, and a bend 216 of the second ripple-shaped flexible washer 210 engages with the cold side 118 of the deflector 68.

In FIG. 11, as an alternative arrangement, a first ripple-shaped flexible washer 218 may be provided, where the first ripple-shaped flexible washer 218 is the same as the first ripple-shaped flexible washer 204, except that the first ripple-shaped flexible washer 218 may include a plurality of cooling openings 222 therethrough. The cooling openings 222 may be similar to the cooling openings 202 shown in FIGS. 9 and 10. Similarly, a second ripple-shaped flexible washer 220 may be provided, where the second ripple-shaped flexible washer 220 is the same as the second ripple-shaped flexible washer 210, except that the second ripple-shaped flexible washer 220 may include a plurality of cooling openings 224 therethrough. The cooling openings 222 may be similar to the cooling openings 202 shown in FIGS. 9 and 10. The cooling openings 222 provide the cooling airflow 82(*c*) to impinge against a cold side 213 of the second ripple-shaped flexible washer 220, and cooling openings 224 provide the cooling airflow 82(*c*) to impinge against the cold side 118 of the deflector 68.

Figure 12:
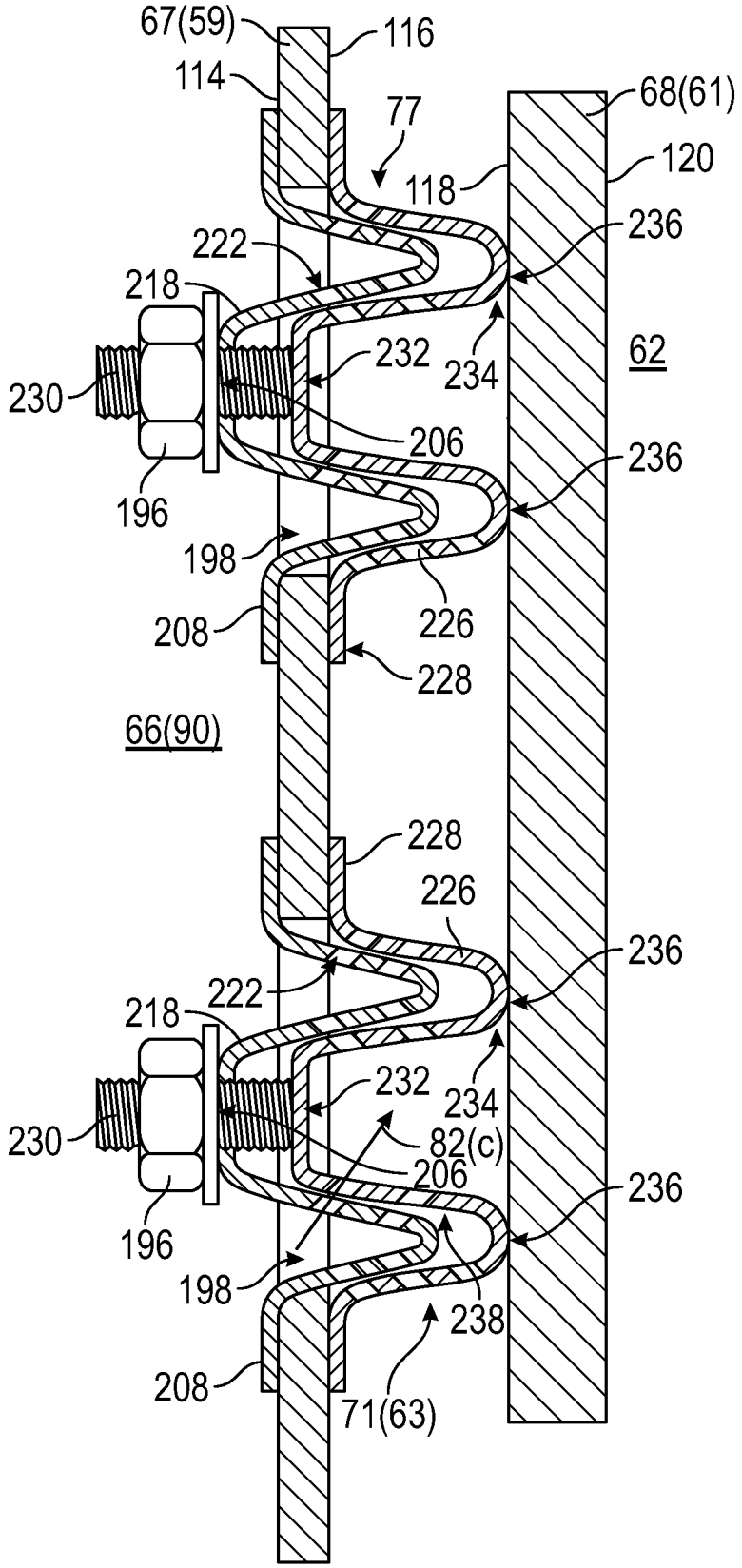
FIG. 12 is a schematic partial cross-sectional view of an alternate aspect of a dome-deflector connection, according to another aspect of the present disclosure.

FIG. 12 is a schematic partial cross-sectional view of an alternate aspect of a dome-deflector connection, according to another aspect of the present disclosure. The FIG. 12 aspect is somewhat similar to the FIG. 11 aspect in that multiple ripple-shaped flexible washers are implemented within the dome-deflector connecting member 71. In the FIG. 12 aspect, the first ripple-shaped flexible washer 218 is included, and the first washer radially outer flange 208 of the first ripple-shaped flexible washer 218 engages with the cold side 114 of the dome 67. One difference between the FIG. 12 aspect and the FIG. 11 aspect lies in a different type of second ripple-shaped flexible washer. In the FIG. 12 aspect, a second ripple-shaped flexible washer 226 is included, where a bend 234 of the second ripple-shaped flexible washer 226 is joined to the cold side 118 of the deflector 68 by, for example being brazed at a joint 236. In addition, the second ripple-shaped flexible washer 226 includes a stud 230 that extends from a center 232 of the second ripple-shaped flexible washer 226. The stud 230 extends through the first washer center opening 206 of the first ripple-shaped flexible washer 218 and the nut 196 threadedly engages the stud 230. A second washer radially outer flange 228 of the second ripple-shaped flexible washer 226 engages with the hot side 116 of the dome 67. Similar to the FIG. 11 aspect, the first ripple-shaped flexible washer 218 may include the cooling openings 222, and the second ripple-shaped flexible washer 226 may include a plurality of cooling openings 238, similar to the cooling openings 224 of FIG. 11. Thus, with the cooling openings 222 and the cooling openings 238, the cooling airflow 82(*c*) may be provided to impinge against the cold side 118 of the deflector 68.

While the foregoing description relates generally to a gas turbine engine, the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

The foregoing aspects of the present disclosure provide for a flexible joint connecting the dome and deflector, and/or connecting the liner shell and the liner panel, so as to better accommodate the thermal expansion of the joints, and to better accommodate the vibrations at the joint. Thus, the various joint arrangements can accommodate thermal loads on the joints and can also accommodate vibrations incurred during the combustion process so as to reduce stress that may otherwise be incurred at the joint, which causes a breakdown of the joint over time.

Further aspects of the present disclosure are provided by the subject matter of the following clauses.

A combustor for a gas turbine, the combustor including a dome, a deflector connected to the dome to define a baffle cavity therebetween, the deflector having a deflector cold side adjacent to the baffle cavity and a deflector hot side adjacent to a combustion chamber, and at least one dome-deflector connecting member connecting the dome and the deflector to each other, the dome-deflector connecting member forming a flexible joint between the dome and the deflector.

The combustor according to the preceding clause, wherein the dome-deflector connecting member comprises a bolted joint including a flexible bolt having a bolt head and a flexible shank portion, the bolt head engaging the deflector on the deflector hot side.

The combustor according to any preceding clause, wherein the flexible shank portion comprises a heli-coil-type shank arranged between the dome and the deflector, the heli-coil-type shank defining a hollow cavity therewithin, and the bolt head having a cooling passage extending therethrough and in fluid communication with the hollow cavity.

The combustor according to any preceding clause, wherein the dome-deflector connecting member comprises a flexible coupler connected to the dome at a first end of the flexible coupler and connected to the deflector at a second end of the flexible coupler.

The combustor according to any preceding clause, wherein the flexible coupler includes a flexible middle section between the first end of the flexible coupler and the second end of the flexible coupler, the flexible middle section comprising any one of a heli-coil structure, a spring-like structure having a plurality of belleville-type washers, and a spring-like structure having a plurality of waveform elements joined to one another.

The combustor according to any preceding clause, wherein the flexible coupler is connected to the dome at the first end via any one of a bolted joint and a mounting bracket joint, and the flexible coupler is connected to the deflector at the second end via any one of a pinned joint and a mounting bracket joint.

The combustor according to any preceding clause, wherein the dome-deflector connecting member comprises a first flexible coupler and a second flexible coupler connected to each other, the first flexible coupler being connected to the dome at a first end of the first flexible coupler and the second flexible coupler being connected to the deflector at a second end of the second flexible coupler.

The combustor according to any preceding clause, wherein the dome-deflector connecting member includes a ripple-shaped flexible washer having a center opening therethrough, and having a radially outer flange, the deflector includes a stud extending from the deflector cold side, the stud extending through the center opening, and the radially outer flange of the ripple-shaped flexible washer engaging a cold side of the dome.

The combustor according to any preceding clause, wherein the ripple-shaped flexible washer includes cooling openings therethrough for providing an impingement cooling airflow to impinge against the deflector cold side.

The combustor according to any preceding clause, wherein the dome-deflector connecting member includes a first ripple-shaped flexible washer having a first washer center opening therethrough, and having a first washer radially outer flange, a second ripple-shaped flexible washer having a second washer center opening therethrough, and having a second washer radially outer flange, the deflector includes a stud extending from the deflector cold side, the stud extending through the first washer center opening and through the second washer center opening, the first washer radially outer flange engaging with a cold side of the dome, and the first ripple-shaped flexible washer extending through a dome opening and into the baffle cavity, and the second washer radially outer flange engaging with a hot side of the dome, and the second ripple-shaped flexible washer engaging with the cold side of the deflector.

The combustor according to any preceding clause, wherein the first ripple-shaped flexible washer includes cooling openings therethrough for providing a cooling airflow to a cold side of the second ripple-shaped flexible washer, and the second ripple-shaped flexible washer includes cooling openings therethrough for providing an impingement cooling airflow to impinge against the cold side of the deflector.

The combustor according to any preceding clause, wherein the dome-deflector connecting member includes (a) a first ripple-shaped flexible washer having a first washer center opening therethrough, and having a first washer radially outer flange, and (b) a second ripple-shaped flexible washer having a stud extending from a center of the second ripple-shaped flexible washer, and having a second washer radially outer flange, the second ripple-shaped flexible washer being joined to the deflector, the stud extending through the first washer center opening, the second washer radially outer flange engaging with a hot side of the dome, and the first washer radially outer flange engaging with a cold side of dome.

The combustor according to any preceding clause, wherein the first ripple-shaped flexible washer includes cooling openings therethrough for providing a cooling airflow to a cold side of the second ripple-shaped flexible washer, and the second ripple-shaped flexible washer includes cooling openings therethrough for providing an impingement cooling airflow to impinge against the cold side of the deflector.

The combustor according to any preceding clause, further comprising a combustor liner including a combustor liner shell and a combustor liner panel connected to the combustor liner shell to define a baffle cavity therebetween, the combustor liner panel being connected to the combustor liner shell via at least one shell-to-panel connecting member at a joint, the shell-to-panel connecting member forming a flexible joint between the combustor liner shell and the combustor liner panel.

The combustor according to any preceding clause, wherein the shell-to-panel connecting member comprises a bolted joint including a flexible bolt having a flexible shank portion.

The combustor according to any preceding clause, wherein the shell-to-panel connecting member comprises a flexible coupler connected to the combustor liner shell at a first end of the flexible coupler and connected to the combustor liner panel at a second end of the flexible coupler, the flexible coupler including a flexible middle portion between the first end and the second end.

The combustor according to any preceding clause, wherein the shell-to-panel connecting member includes a ripple-shaped flexible washer having a center opening therethrough, and having a radially outer flange, the combustor liner panel includes a stud extending from a cold side of the combustor liner panel, the stud extending through the center opening, and the radially outer flange of the ripple-shaped flexible washer engaging the combustor liner shell.

The combustor according to any preceding clause, wherein the shell-to-panel connecting member includes (a) a first ripple-shaped flexible washer having a first washer center opening therethrough, and having a first washer radially outer flange, and (b) a second ripple-shaped flexible washer having a second washer center opening therethrough, and having a second washer radially outer flange, the combustor liner panel includes a stud extending from a cold side of the combustor liner panel, the stud extending through the first washer center opening and through the second washer center opening, the first washer radially outer flange engaging with a cold side of the combustor liner shell, and the second washer radially outer flange engaging with a hot side of the combustor liner shell.

The combustor according to any preceding clause, wherein the shell-to-panel connecting member includes (a) a first ripple-shaped flexible washer having a first washer center opening therethrough, and having a first washer radially outer flange, and (b) a second ripple-shaped flexible washer having a stud extending from a center of the second ripple-shaped flexible washer, and having a second washer radially outer flange, the second ripple-shaped flexible washer being joined to the combustor liner panel, the stud extending through the first washer center opening, the second washer radially outer flange engaging with a hot side of the combustor liner shell, and the first washer radially outer flange engaging with a cold side of combustor liner shell.

The combustor according to any preceding clause, wherein the first ripple-shaped flexible washer includes cooling openings therethrough for providing a cooling airflow to a cold side of the second ripple-shaped flexible washer, and the second ripple-shaped flexible washer includes cooling openings therethrough for providing an impingement cooling airflow to impinge against the cold side of the combustor liner panel.

Although the foregoing description is directed to some exemplary embodiments of the present disclosure, other variations and modifications will be apparent to those skilled in the art, and may be made without departing from the spirit or the scope of the disclosure. Moreover, features described in connection with one embodiment of the present disclosure may be used in conjunction with other embodiments, even if not explicitly stated above.

We claim:

1. A combustor for a gas turbine, the combustor comprising:

a dome;

a deflector connected to the dome to define a baffle cavity therebetween, the deflector having a deflector cold side adjacent to the baffle cavity and a deflector hot side adjacent to a combustion chamber; and at least one dome-deflector connecting member connecting the dome and the deflector to each other, wherein the at least one dome-deflector connecting member comprises a bolted joint including a bolt having a bolt head and a shank, the bolt head engaging the deflector on the deflector hot side, and wherein the shank comprises a hollow cylindrical shank portion, the hollow cylindrical shank portion being unthreaded and defining a hollow cavity within the shank, a helical serration formed through the hollow cylindrical shank portion along a length of the hollow cylindrical shank portion so as to define a heli-coil shank portion, the heli-coil shank portion being arranged between the dome and the deflector, the helical serration defining an airflow path for providing a flow of cooling airflow from the baffle cavity through the helical serration to the hollow cavity, and the bolt head having a cooling passage extending therethrough and in fluid communication with the hollow cavity.

2. A combustor for a gas turbine, the combustor comprising:

a dome;

a deflector connected to the dome to define a baffle cavity therebetween, the deflector having a deflector cold side adjacent to the baffle cavity and a deflector hot side adjacent to a combustion chamber; and at least one dome-deflector connecting member connecting the dome and the deflector to each other, wherein the at least one dome-deflector connecting member comprises at least one coupler connected to the dome at a first end of the coupler and connected to the deflector at a second end of the coupler, and wherein the at least one coupler includes a hollow cylindrical middle section between the first end of the coupler and the second end of the coupler, the hollow cylindrical middle section being unthreaded and defining a hollow cavity within the at least one coupler, a helical serration formed through the hollow cylindrical middle section along a length of the hollow cylindrical middle section so as to define a heli-coil structure, and wherein the hollow cavity is in fluid communication with the baffle cavity via the helical serration.

3. The combustor according to claim 2, wherein the at least one coupler is connected to the dome at the first end via any one of a bolted joint and a mounting bracket joint, and the at least one coupler is connected to the deflector at the second end via any one of a pinned joint and a mounting bracket joint.

4. The combustor according to claim 2, wherein the at least one coupler comprises a first coupler and a second coupler connected to each other, the first coupler being connected to the dome at a first end of the first coupler and the second coupler being connected to the deflector at a second end of the second coupler.

5. A combustor for a gas turbine, the combustor comprising:

a dome;

a deflector connected to the dome to define a baffle cavity therebetween, the deflector having a deflector cold side adjacent to the baffle cavity and a deflector hot side adjacent to a combustion chamber; and at least one dome-deflector connecting member connecting the dome and the deflector to each other, wherein the at least one dome-deflector connecting member includes a ripple-shaped washer having a center opening therethrough, and having a radially outer flange, the deflector includes a stud extending from the deflector cold side, the stud extending through the center opening, and the radially outer flange of the ripple-shaped washer engaging a cold side of the dome, and wherein the ripple-shaped washer includes cooling openings therethrough for providing an impingement cooling airflow to impinge against the deflector cold side.

6. A combustor for a gas turbine, the combustor comprising:

a dome;

a deflector connected to the dome to define a baffle cavity therebetween, the deflector having a deflector cold side adjacent to the baffle cavity and a deflector hot side adjacent to a combustion chamber; and at least one dome-deflector connecting member connecting the dome and the deflector to each other, wherein the at least one dome-deflector connecting member includes a first ripple-shaped washer having a first washer center opening therethrough, and having a first washer radially outer flange, a second ripple-shaped washer having a second washer center opening therethrough, and having a second washer radially outer flange, the deflector includes a stud extending from the deflector cold side, the stud extending through the first washer center opening and through the second washer center opening, the first washer radially outer flange engaging with a cold side of the dome, and the first ripple-shaped washer extending through a dome opening and into the baffle cavity, and the second washer radially outer flange engaging with a hot side of the dome, and the second ripple-shaped washer engaging with the cold side of the deflector, and wherein the first ripple-shaped washer includes cooling openings therethrough for providing a cooling airflow to a cold side of the second ripple-shaped washer, and the second ripple-shaped washer includes cooling openings therethrough for providing an impingement cooling airflow to impinge against the cold side of the deflector.

7. A combustor for a gas turbine, the combustor comprising:

a dome;

a deflector connected to the dome to define a baffle cavity therebetween, the deflector having a deflector cold side adjacent to the baffle cavity and a deflector hot side adjacent to a combustion chamber; and at least one dome-deflector connecting member connecting the dome and the deflector to each other, wherein the at least one dome-deflector connecting member includes (a) a first ripple-shaped washer having a first washer center opening therethrough, and having a first washer radially outer flange, and (b) a second ripple-shaped washer having a stud extending from a center of the second ripple-shaped flexible washer, and having a second washer radially outer flange, the second ripple-shaped washer being joined to the deflector, the stud extending through the first washer center opening, the second washer radially outer flange engaging with a hot side of the dome, and the first washer radially outer flange engaging with a cold side of dome, and wherein the first ripple-shaped washer includes cooling openings therethrough for providing a cooling airflow to a cold side of the second ripple-shaped washer, and the second ripple-shaped washer includes cooling openings therethrough for providing an impingement cooling airflow to impinge against the cold side of the deflector.

8. The combustor according to claim 1, further comprising a combustor liner including a combustor liner shell and a combustor liner panel connected to the combustor liner shell to define a baffle cavity therebetween, the combustor liner panel being connected to the combustor liner shell via at least one shell-to-panel connecting member at a joint, the at least one shell-to-panel connecting member forming a joint between the combustor liner shell and the combustor liner panel.

9. The combustor according to claim 8, wherein the at least one shell-to-panel connecting member comprises a bolted joint including a bolt having a heli-coil shank portion.

10. The combustor according to claim 8, wherein the at least one shell-to-panel connecting member comprises a coupler connected to the combustor liner shell at a first end of the coupler and connected to the combustor liner panel at a second end of the coupler, the coupler including a heli-coil middle portion between the first end and the second end.

11. The combustor according to claim 8, wherein the at least one shell-to-panel connecting member includes a ripple-shaped washer having a center opening therethrough, and having a radially outer flange, the combustor liner panel includes a stud extending from a cold side of the combustor liner panel, the stud extending through the center opening, and the radially outer flange of the ripple-shaped washer engaging the combustor liner shell.

12. The combustor according to claim 8, wherein the at least one shell-to-panel connecting member includes (a) a first ripple-shaped washer having a first washer center opening therethrough, and having a first washer radially outer flange, and (b) a second ripple-shaped washer having a second washer center opening therethrough, and having a second washer radially outer flange, the combustor liner panel includes a stud extending from a cold side of the combustor liner panel, the stud extending through the first washer center opening and through the second washer center opening, the first washer radially outer flange engaging with a cold side of the combustor liner shell, and the second washer radially outer flange engaging with a hot side of the combustor liner shell.

13. A combustor for a gas turbine, the combustor comprising:

a dome;

a deflector connected to the dome to define a baffle cavity therebetween, the deflector having a deflector cold side adjacent to the baffle cavity and a deflector hot side adjacent to a combustion chamber;

at least one dome-deflector connecting member connecting the dome and the deflector to each other; and a combustor liner including a combustor liner shell and a combustor liner panel connected to the combustor liner shell to define a baffle cavity therebetween, the combustor liner panel being connected to the combustor liner shell via at least one shell-to-panel connecting member at a joint, the at least one shell-to-panel connecting member forming a joint between the combustor liner shell and the combustor liner panel, wherein the at least one shell-to-panel connecting member includes (a) a first ripple-shaped washer having a first washer center opening therethrough, and having a first washer radially outer flange, and (b) a second ripple-shaped washer having a stud extending from a center of the second ripple-shaped washer, and having a second washer radially outer flange, the second ripple-shaped washer being joined to the combustor liner panel, the stud extending through the first washer center opening, the second washer radially outer flange engaging with a hot side of the combustor liner shell, and the first washer radially outer flange engaging with a cold side of combustor liner shell, and wherein the first ripple-shaped washer includes cooling openings therethrough for providing a cooling airflow to a cold side of the second ripple-shaped washer, and the second ripple-shaped washer includes cooling openings therethrough for providing an impingement cooling airflow to impinge against the cold side of the combustor liner panel.

* * * * *